US005647517A

United States Patent [19]

Foster et al.

[11] Patent Number: 5,647,517

[45] Date of Patent: Jul. 15, 1997

[54] CUFF MAKING APPARATUS

[75] Inventors: Wayne G. Foster; John R. Everhart, both of Winston-Salem; Joel C. Rosenquist, Kernersville; Ken J. Thompson, Lexington, all of N.C.

[73] Assignee: Sara Lee Corporation, Winston Salem, N.C.

[21] Appl. No.: 505,401

[22] Filed: Jul. 21, 1995

[51] Int. Cl.[6] ..... A41H 43/00

[52] U.S. Cl. ..... 223/2

[58] Field of Search ..... 493/269; 83/54; 223/2, 3, 1, 37, 38

[56] References Cited

U.S. PATENT DOCUMENTS

| | | | |
|---|---|---|---|
| 1,586,667 | 6/1926 | Fournier | 223/2 |
| 2,242,665 | 5/1941 | Underwood | 223/2 |
| 2,249,968 | 7/1941 | McDonald | 223/2 |
| 2,951,322 | 9/1960 | McCorkle Wood | 493/269 |
| 3,124,872 | 3/1964 | Knodel, Jr. | 493/269 |
| 4,381,068 | 4/1983 | Raisin et al. | 223/2 |
| 5,271,137 | 12/1993 | Schutz | 83/54 |

*Primary Examiner*—Bibhu Mohanty

*Attorney, Agent, or Firm*—Rhodes Coats & Bennett, L.L.P.

[57] ABSTRACT

An apparatus for making a cuff from a continuous supply of tubular material. The apparatus includes a material feed for advancing the tubular material. A cutter is disposed adjacent the material feed for severing the tubular material to form a circular band. A holding fixture receives and holds the circular band severed from the tubular cuff material in an open position. The holding fixture includes gripping means formed in the holding fixture for gripping the circular band between the ends thereof. A folding mechanism folds the circular band on the holding fixture upon itself to form a double-layer cuff which is subsequently attached to the garment either automatically or manually.

15 Claims, 12 Drawing Sheets

CUFF MAKING APPARATUS

BACKGROUND OF THE INVENTION (1) Field of the Invention

The present invention relates generally to automated manufacturing systems and, more particularly, to an apparatus for automatically making a cuff for a sleeve or pant leg for a sweat suit or the like.

(2) Description of the Prior Art

The manufacture of textile clothing articles such as sweat suits and outer garments has resisted automation. This is due largely because of the difficulty in accurately handling so called "soft" materials. For example, the fleece material commonly used in sweat suits may wrinkle, stick to one another and stretch significantly when handled.

Even where automation has begun to make in-roads, other difficulties remain. For example, cuffs for sleeves and pant legs for sweat suits or the like must be manually formed and then placed and sewn to set the cuff. This has always been a manual operation because of the dexterity required to form and position the cuff properly prior to sewing. Unfortunately, repetitive actions such as forming and setting a cuff to a garment may cause health problems. However, it has been extremely difficult to design a device which can reliably form, position the cuff and sew it time after time.

Thus, there remains a need for an apparatus for automatically making a cuff for a sleeve or pant leg for a sweat suit or the like which will operate reliably time after time while, at the same time, can be carried out completely automatically without the need for a skilled operator.

SUMMARY OF THE INVENTION

The present invention is directed to an apparatus for making a cuff from a continuous supply of tubular material. The apparatus includes a material feed for advancing the tubular material. A cutter is disposed adjacent the material feed for severing the tubular material to form a circular band. A holding fixture receives and holds the circular band severed from the tubular cuff material in an open position. The holding fixture includes gripping means formed in the holding fixture for gripping the circular band between the ends thereof. A folding mechanism folds the circular band on the holding fixture upon itself to form a double-layer cuff which is subsequently attached to the garment either automatically or manually.

Accordingly, one aspect of the present invention is to provide an apparatus for making a cuff from a continuous supply of tubular material. The apparatus includes: (a) a material feed for advancing the tubular material; (b) a cutter disposed adjacent the material feed for severing the tubular material to form a circular band; and (c) a holding fixture for holding the circular band severed from the tubular cuff material.

Another aspect of the present invention is to provide an apparatus for holding a circular band to form a cuff. The apparatus includes: (a) a holding fixture for receiving and holding the circular band in an open position; and (b) gripping means formed in the holding fixture for gripping the circular band between the ends thereof.

Still another aspect of the present invention is to provide an apparatus for making a cuff from a continuous supply of tubular material. The apparatus includes: (a) a material feed for advancing the tubular material; (b) a cutter disposed adjacent the material feed for severing the tubular material to form a circular band; (c) a holding fixture for receiving and holding the circular band severed from the tubular cuff material in an open position, the holding fixture including gripping means formed in the holding fixture for gripping the circular band between the ends thereof; and (d) a folding mechanism for folding the circular band on the holding fixture upon itself to form a double-layer cuff.

These and other aspects of the present invention will become apparent to those skilled in the art after a reading of the following description of the preferred embodiment when considered with the drawings.

DESCRIPTION OF THE PREFERRED EMBODIMENTS

Figure 1:
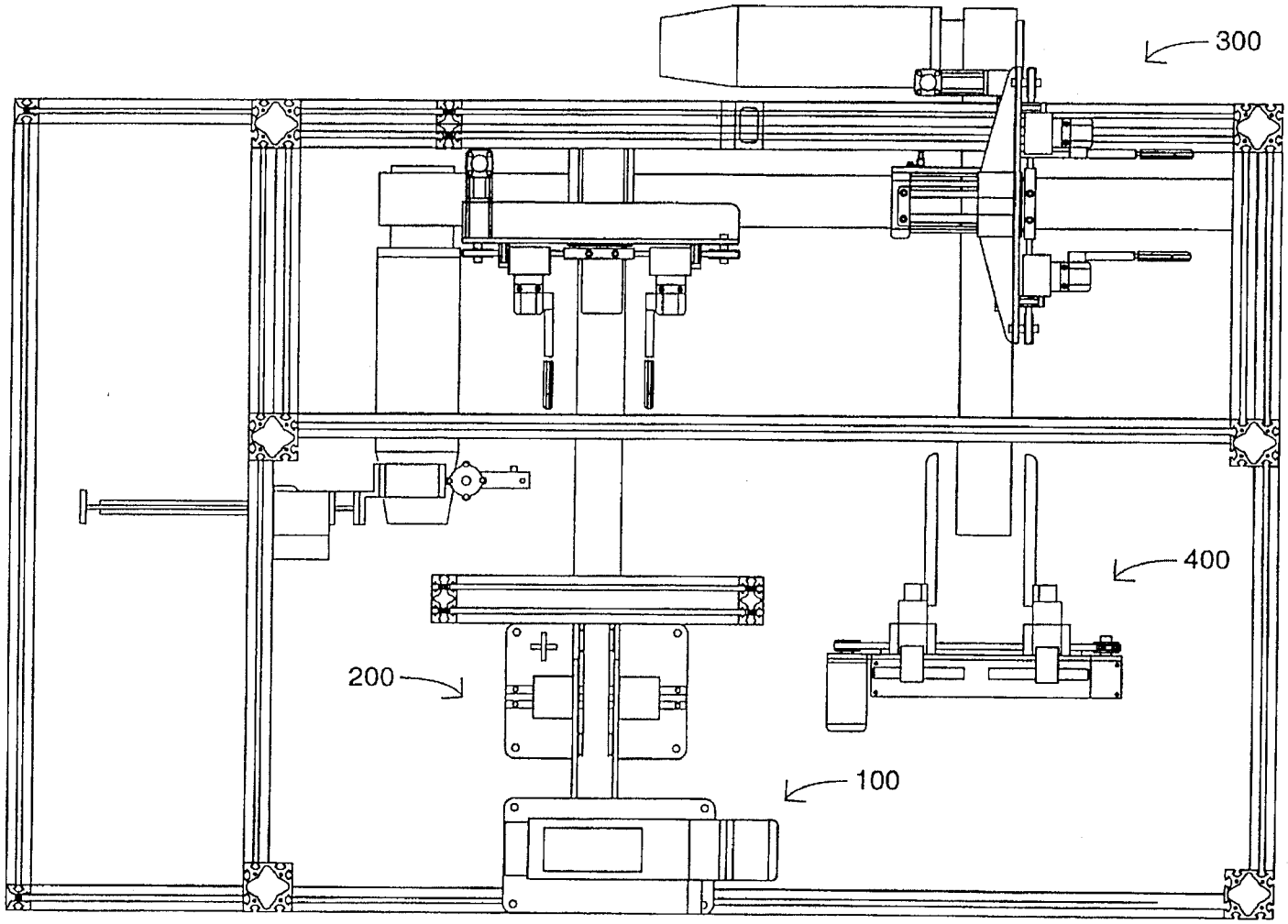
FIG. 1 is a top plan view of a cuff making apparatus constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a cuff making apparatus, generally designated 10, is shown constructed according to the present invention. The cuff making apparatus 10 is designed to manufacture cuffs from a continuous supply of tubular material. The tubular material is first fed through a cutting apparatus which severs the tubular material to form a circular band. The circular band is then folded upon itself to form a double layer cuff which can be sewn to the sleeve of a garment. The apparatus of the present invention could also be used to manufacture waistbands, collars and other components of garments in which a circular band is folded upon itself.

As shown in FIG. 1, apparatus 10 includes a feed assembly 100 for feeding the cuff material into the apparatus, a cutter assembly 200 for severing the tubular cuff material to form circular bands, a holding fixture 300 for holding the circular bands after they have been severed from the tubular cuff material, and a cuff folder assembly 400 for folding the circular bands to form the double-layered cuff. Once the cuff has been manufactured in accordance with the present invention, the cuff can be inserted and sewn into the sleeve of a garment, such as a sweat shirt.

Feed Assembly

Figure 5:
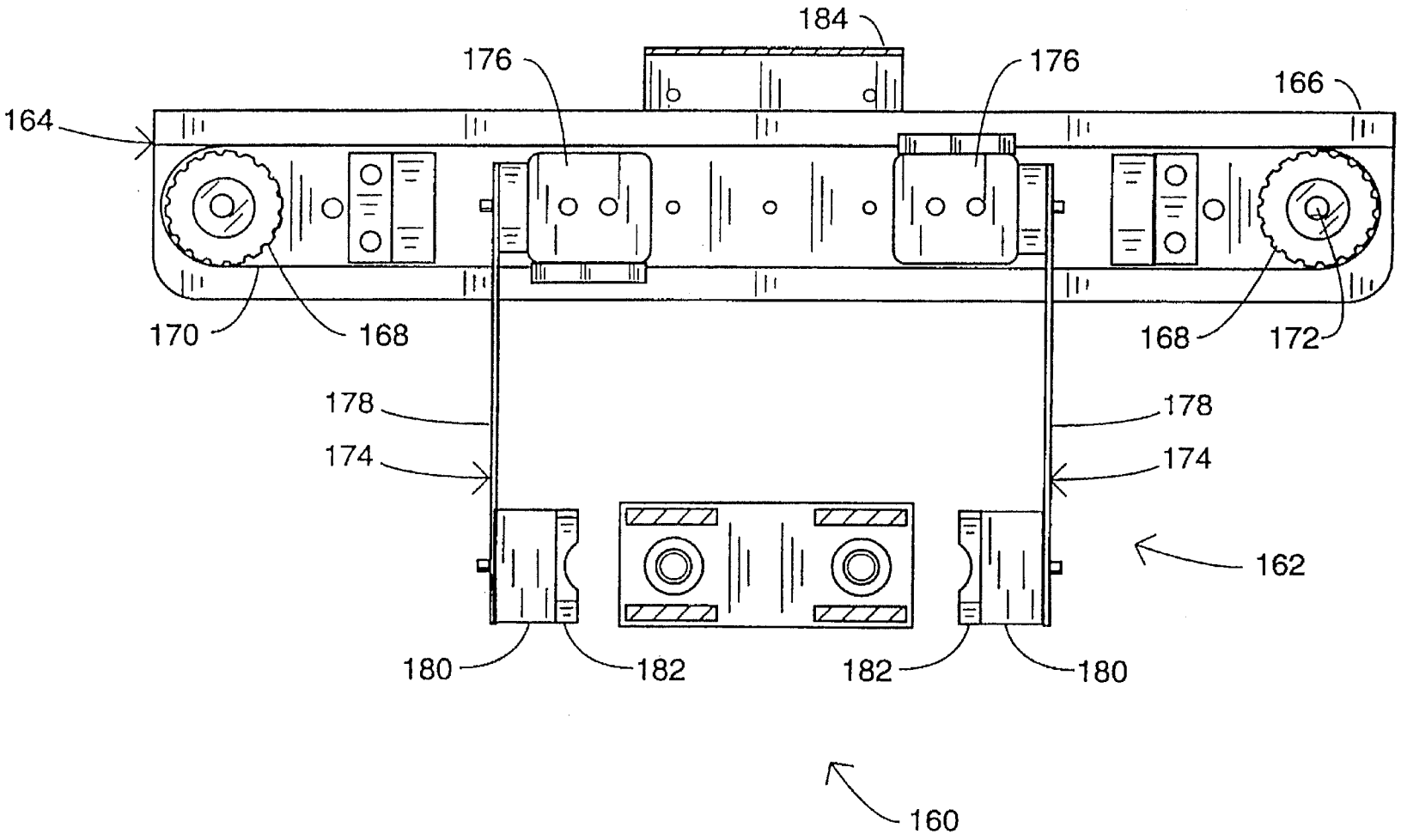
FIG. 5 is a front elevation view of the cuff puller assembly.
Figure 6:
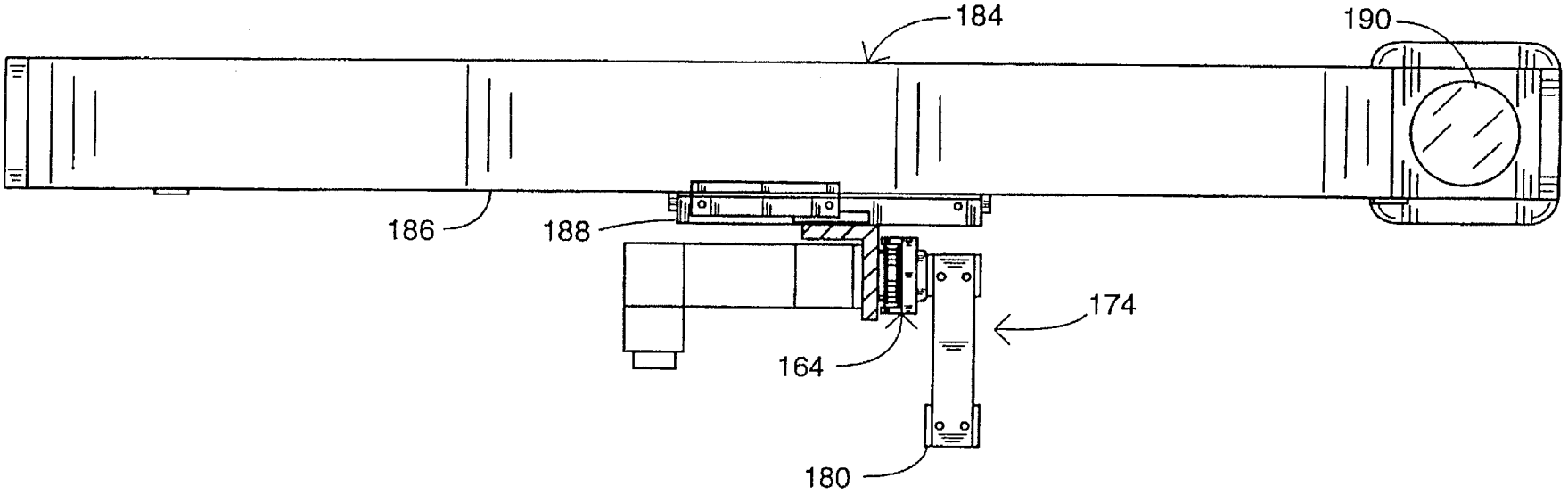
FIG. 6 is a side elevation view of the cuff puller assembly.

The feed assembly 100 feeds a continuous supply of tubular cuff material into cuff making apparatus 10. The cuff material feed assembly 100 includes three sub-assemblies—a feed roller assembly 102 (FIGS. 2 and 3), a tube opener assembly 130 (FIGS. 3 and 4), and a cuff puller assembly 160 (FIGS. 5 and 6). The feed roller assembly 102 feeds the cuff material while the cuff puller assembly 160 pulls the cuff material through the tube opener assembly. The tube opener assembly 130 opens the tube as it is being advanced. Each of the sub-assemblies is described in turn below.

Figure 2:
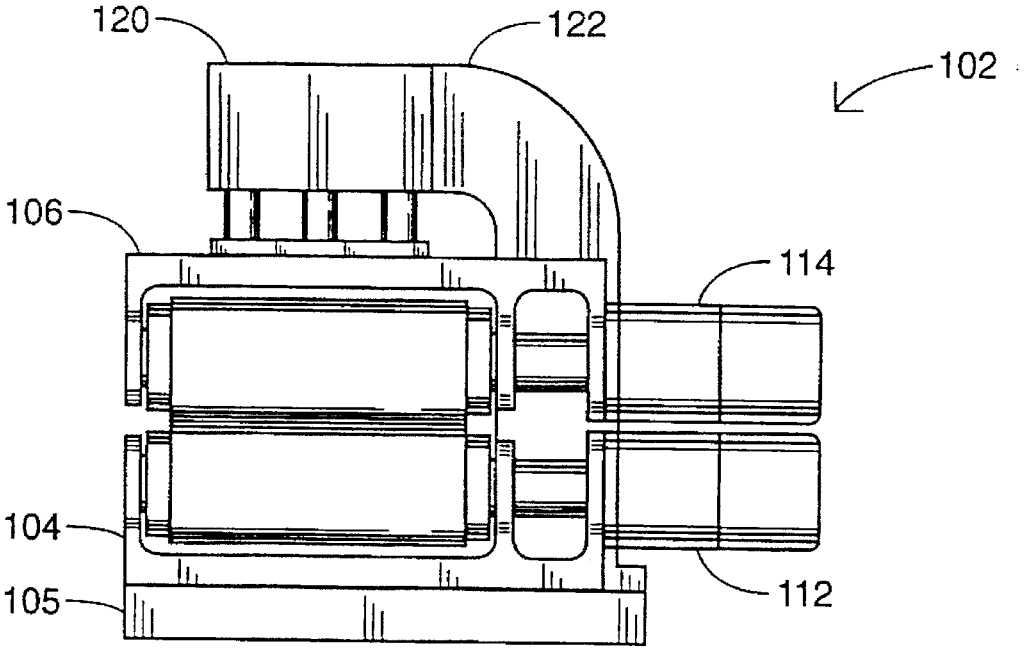
FIG. 2 is a front elevation view of the feed roller assembly.
Figure 3A:
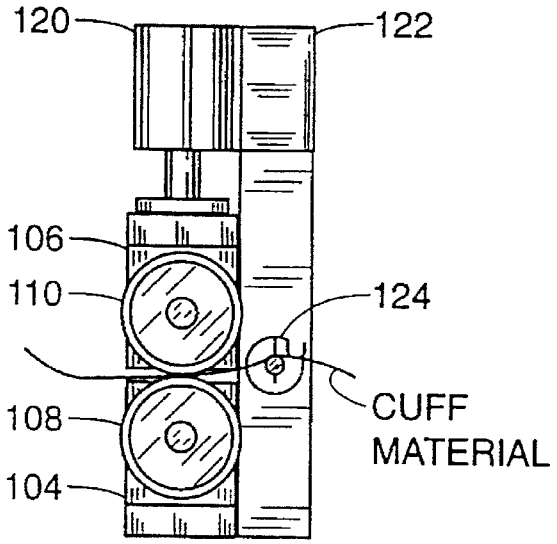
FIGS. 3A–3B are partial side elevation views of the feed roller assembly and tube opener assembly.

The feed roller assembly 102, shown in FIGS. 2 and 3, includes a pair of counter-rotating feed rollers 108 and 110. The lower feed roller 108 is mounted in a roller bracket 104 which is fixedly secured to a support surface 105. The upper feed roller 110 is mounted for rotation in a roller bracket 106 which is movable in a vertical direction. Roller bracket 106 is connected to a cylinder 120 which is supported by a frame member 122. Cylinder 120 functions to raise and lower the upper roller 110 into and out of engagement with the lower roller 108.

Each of the rollers 108, 110 includes a separate drive motor 112, 114 respectively. The drive motors 112 and 114 are preferably stepper motors which rotate a predetermined amount each time the motor is actuated to feed a predetermined amount of tubular cuff material.

An edge guide 124 is disposed adjacent to the nip between the rollers 108 and 110. The purpose of the edge guide 124 is to keep the cuff material aligned as it is fed into the cuff making apparatus 10.

The cuff material is fed by the feed roller assembly through a tube opener assembly 130. Normally, the cuff material is fed in a flattened condition. The function of the tube opener assembly 130 is to spread open the tubular cuff material.

Figure 3B:
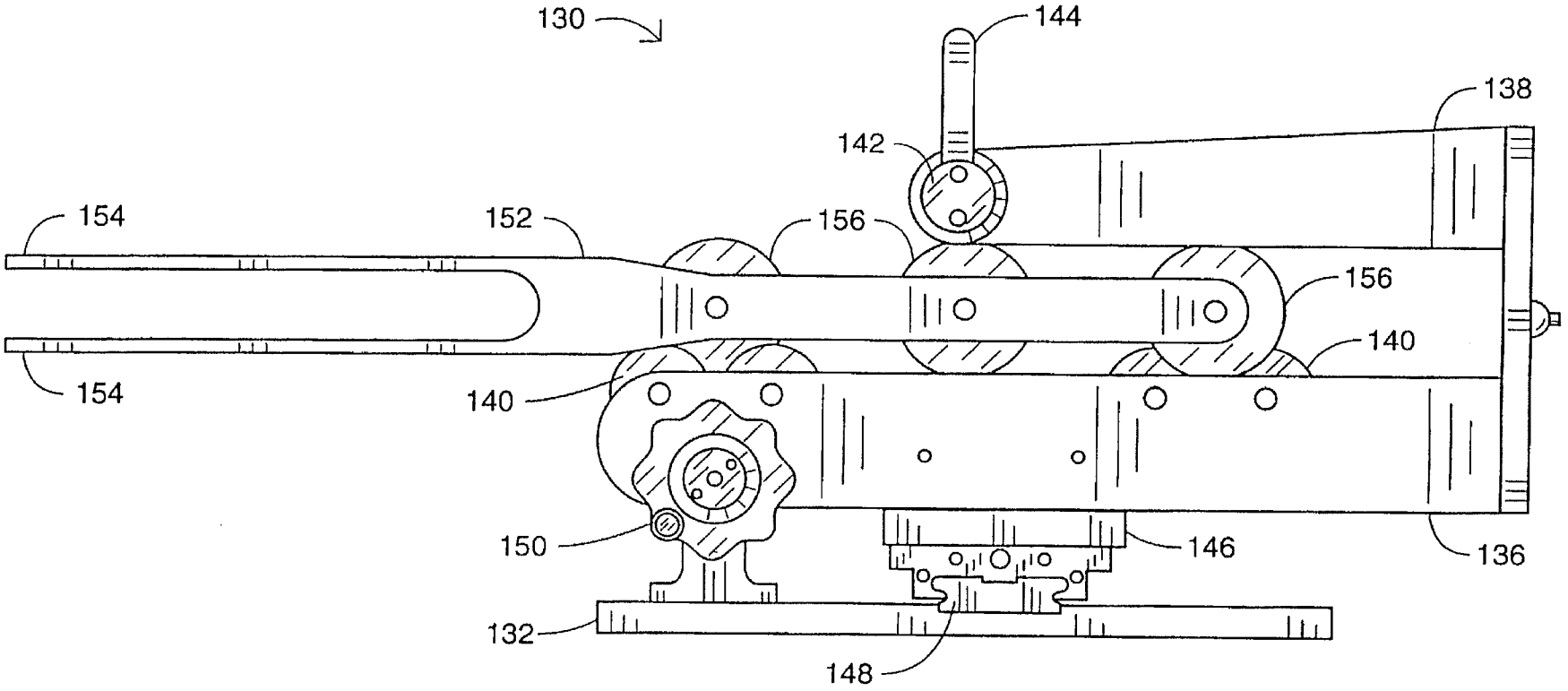
Figure 4:
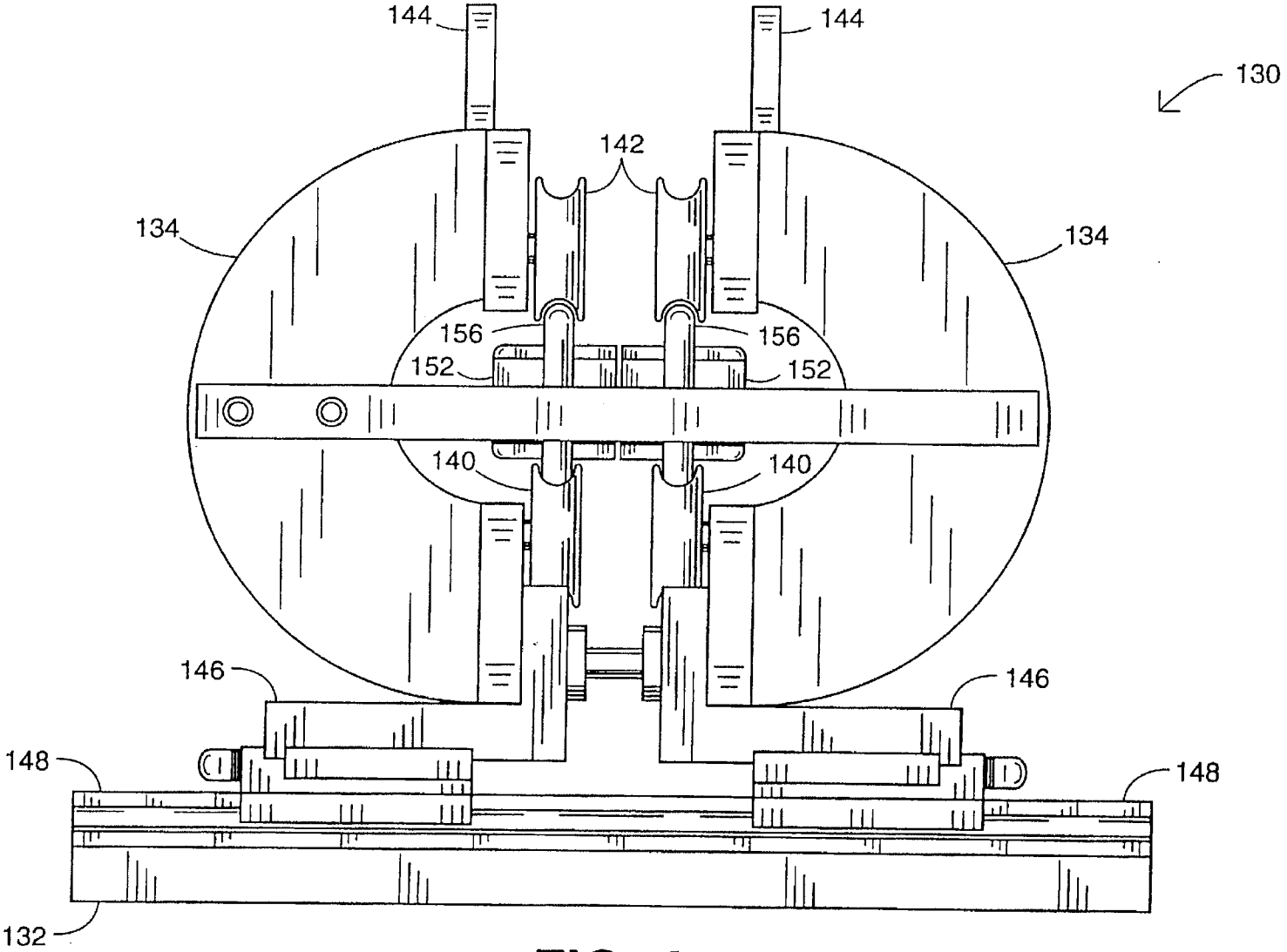
FIG. 4 is a front elevation view of the tube opener assembly.

The tube opener assembly 130, shown in FIGS. 3B and 4, comprises a support frame indicated generally at 132, and a pair of tube opening forks 152. The support frame 132 includes a pair of C-shaped brackets 134 which are mounted on carriages 146. Each carriage 146 is mounted for sliding movement on a track 148. A crank 150 is turned to move the carriages 146 on the track 148. The carriages 146 move in opposite directions from one another. Thus, when the crank 150 is turned in a first direction, the carriages 146 will move closer to one another. When the crank 150 is turned in a second direction, the carriages 146 move away from one another. The movable carriages 146 allow for adjustment depending upon the size of the cuff material being fed.

Referring back to the support frame 132, a pair of support arms 136,138 are fixedly secured to the C-shaped brackets 134 and extend forwardly therefrom in the direction of feed of the tubular cuff material. The lower support arm 136 includes two pairs of idler pulleys 140. The upper support arm 138 includes a retaining pulley 142 which is eccentrically mounted. A locking lever 144 is attached to the retaining pulley 142.

The tube opening forks 152 are mounted in parallel, spaced relationship in the support frame 132. Each tube opening fork 152 includes a pair of vertically spaced tines 154. Each fork 152 includes three support rollers 156 which are rotatably mounted to the back end of the fork 152. The back end of each fork 152 is inserted into the support frame 132 so that the outer support rollers 156 rest on respective pairs of idler pulleys 140. The center pulley 156 is engaged by the retaining pulley 142 to secure the fork 152 within the support frame 132. The retaining pulley 142 is engaged with the center roller 156 by moving the locking lever 142 from a release position to a clamping position.

The tube opener assembly 130 is positioned in front of the feed roller assembly 102. The flattened tubular cuff material is fed between the C-shaped brackets 134 and over the opening forks 152. Normally, the forks 152 are inserted into the end of the tubular cuff material before the forks 152 are clamped in the support frame 132. As the cuff material is fed over the tube opening forks 152, the tines 154 of the forks 152 spread the tubular material and hold the tubular cuff material in a open configuration. In this configuration, the holding fixture 300 can be inserted into the cuff material as will be described in greater detail below.

The puller assembly 160, shown in FIG. 5 and 6, includes a gripper assembly 162 which is movably mounted on a linear slide 184. The gripper assembly 162 grips the tubular cuff material on the tube opening forks 152 and then moves in the direction of feed to pull the cuff material.

The gripper assembly 162 includes a pair of grippers 174 and a gripper drive assembly 164. The gripper drive assembly 164 includes a support frame 166. A pair of belt pulleys 168 are rotatably mounted to the support frame 166. A drive belt 170 is entrained around the belt pulleys 168. One of the belt pulleys 168 is driven by a belt motor 172. The belt motor 172 is preferably a servo-motor controlled by a programmable controller.

Each of the grippers 174 includes a clamping block 176 for clamping the gripper 174 onto the drive belt 170. One of the grippers 174 is clamped to the upper run of the drive belt 170, while the opposite gripper 174 is clamped to the lower run. Thus, it will be appreciated that the grippers 174 move in opposite directions to one another with rotation of drive pulley 168.

A resilient gripper arm 178 extends downwardly from the clamping block 176. A block member 180 is mounted at the lower end of each gripper arm 178. The block member 180 includes a recess for receiving rubber gripper pads 182. The gripper pads 182 include a semi-circular recess.

The gripper assembly 162 is mounted on a linear slide 184. The linear slide 184 includes a track 186 which extends in the direction of feed of the tubular cuff material. A slide member 188 is mounted on the track 186 and is actuated by a servo-motor 190. Servomotor 190 is controlled by a programmable controller.

The puller assembly 160 cooperates with the holding fixture 300 to grip the tubular cuff material disposed on the tubular opener assembly 130 and to pull the cuff material forwardly a predetermined distance. The holding fixture 300 includes a pair of support fingers 312 which are inserted into the tubular cuff material. While the tubular cuff material is disposed on the tube opening forks 152, the holding fixture moves forwardly on its track and inserts the fingers 312 into the tubular cuff material. After the fingers are inserted into the tubular cuff material, the fingers spread apart from one another. The gripper assembly 162 is then actuated to move the grippers 174 inwardly to press the cuff material against the support fingers 312. Once the tubular cuff material is gripped between the fingers 312 of the holding fixture 300 and the grippers 174, both the puller assembly 160 and holding fixture move in the direction of feed of the cuff material to pull the cuff material. After the cuff material is pulled forwardly, the cutter assembly 200 severs the end of the cuff material to form a circular band which is held by the holding fixture.

Cutter Assembly

Figure 7:
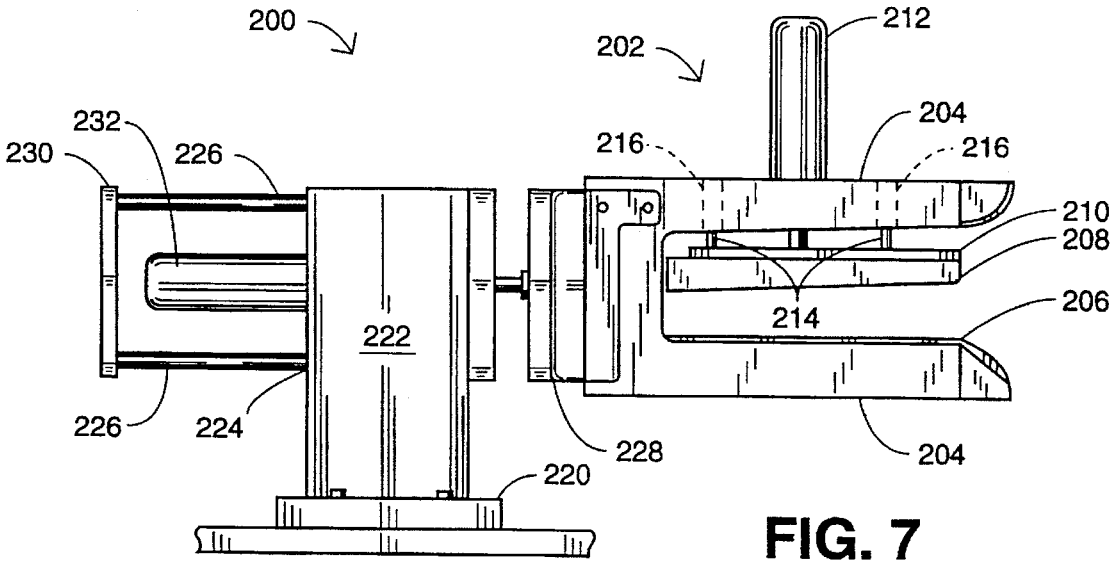
FIG. 7 is a front elevation view of the cutter assembly.

The cutter assembly 200, shown in FIG. 7, comprises a guillotine-type cutter 202 mounted on a support 220. The cutter 202 includes a C-shaped support 204 A stationary blade 206 is fixedly secured to the lower arm of the 204. A movable blade 208 is mounted to the upper arm of the support 204. The stationary blade 206 and movable blade 208 function like a shear to sever the tubular cuff material.

The movable blade 208 is mounted to a blade carrier 210. The blade carrier 210 is connected to a cylinder 212 for moving the blade carrier 210 vertically. The cylinder 212 is mounted on the upper arm of the C-arm 204. A pair of guide posts 214 extend upwardly from the blade carrier 210 and pass through guide openings 216 in the upper arm of the support 204. The guide posts 214 function to keep the movable blade properly aligned with the stationary blade 206.

As discussed above, the cutter 202 is mounted to the support 220. The carrier 220 includes a support block 222 which is mounted to a support surface. Guide holes 224 are formed in the support block 222. A pair of guide rods 226 extend through the guide holes 224 in the support block 222. A support bracket 228 is mounted at one end of the guide rods 226. The support bracket 228 is connected to and supports the cutter 202. An end plate 230 is connected to the opposite end of the guide rods 226. The end plate 230 functions as a stop when the cutter 202 is moved forwardly.

The cutter 202 is moved forwardly and backwardly by a cylinder 232. Cylinder 232 is mounted to the support block 202 and is connected to the support bracket 228. When the cylinder 232 is extended, the cutter 202 is moved forwardly into position to sever the tubular cuff material. After severing the tubular cuff material, the cutter 202 is moved back to a retracted position by cylinder 232. When the cuff material is severed, a circular band is formed.

Holding Fixture

Figure 8:
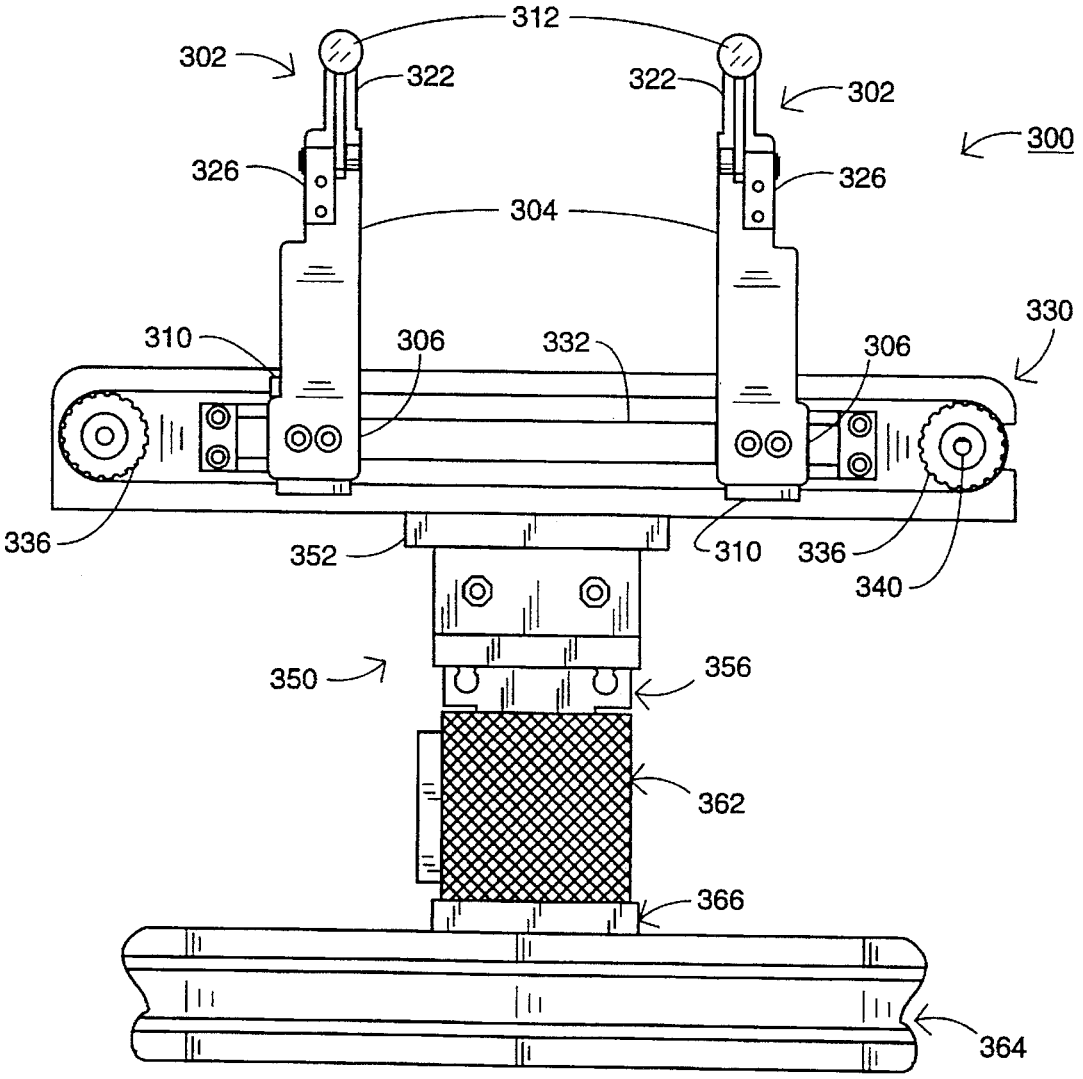
FIG. 8 is a front elevation view of the holding fixture.
Figure 9:
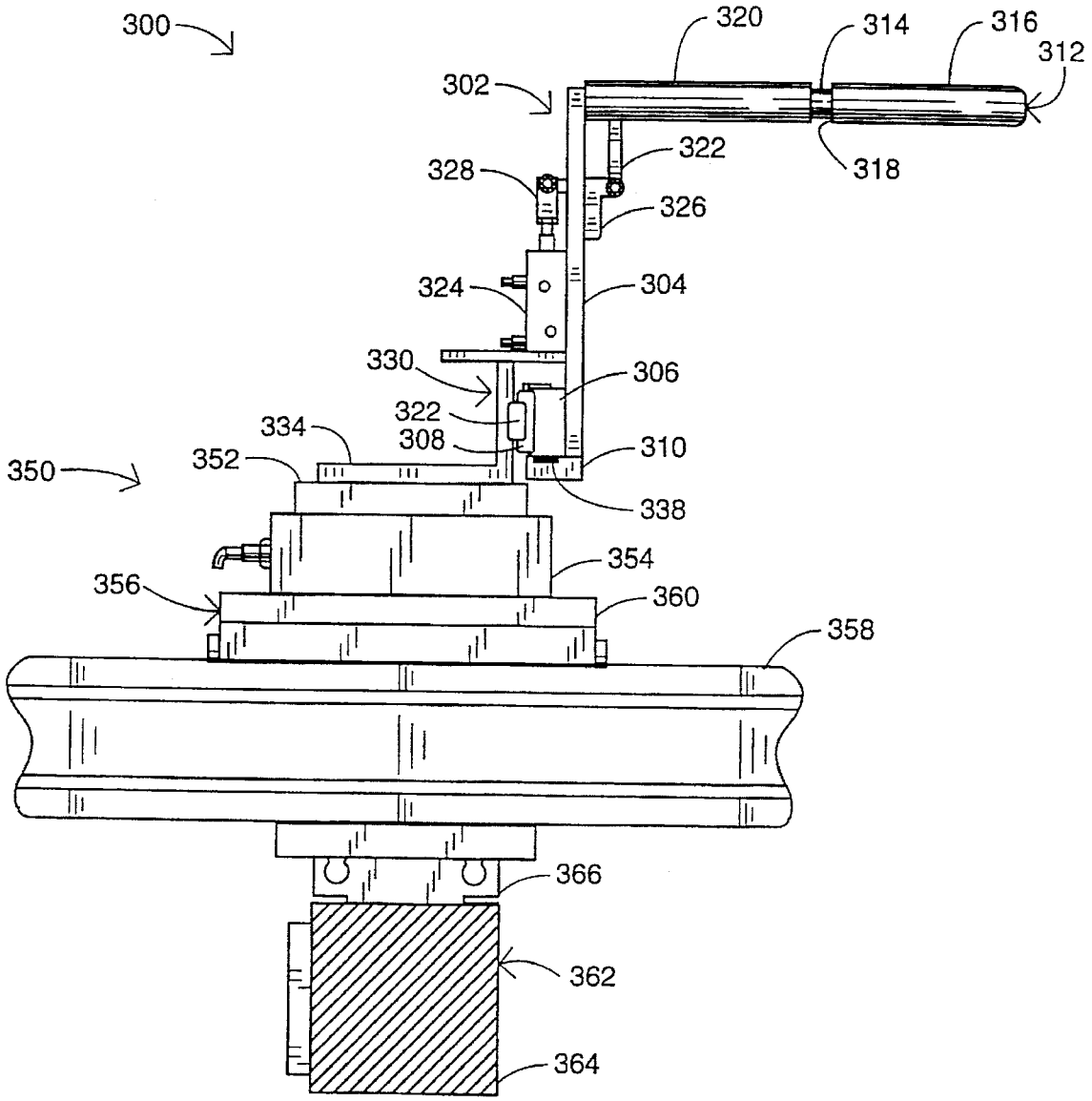
FIG. 9 is a side elevation view of the holding fixture.

The holding fixture 300, shown in FIGS. 8 and 9, receives and holds the circular bands severed from the tubular cuff material and transports the circular bands to the cuff folder assembly. The holding fixture 300 includes a pair of band holders 302 which are movable relative to one another by a band holder drive assembly 330. The band holder drive assembly 330 is, in turn, mounted on a positioner 350 which is used to position the holding fixture 300.

Each band holder 302 includes a support post 304. A clamping block 306 is secured to the lower end of the support post 304. A support finger 312 projects outwardly from the upper end of the support post 304. The support finger 312 includes first and second portions 314 and 316. The second portion 316 has a larger diameter than the first portion 314 so that a shoulder 318 is formed between the first and second portions 314 and 316.

A finger sleeve 320 is slidably mounted on the first portion 314 of the support finger 312. The finger sleeve 300 is movable between a closed position in which one end of the finger sleeve 320 pressed against the shoulder 318, and an open position in which the finger sleeve 320 is spaced from the shoulder 318.

The finger sleeve 320 is movable between the open position and the closed position by a cylinder 324. The cylinder 324 is mounted to the support post 304. Cylinder 324 is connected to a yoke 328. A linkage 322, which is pivotally mounted on a link support 326, connects the finger sleeve 320 to the yoke 328. Thus, the actuation of the cylinder 324 causes the finger sleeve 320 to move back and forth between the open position and the closed position.

The band holder drive assembly 330 moves the band holders 302 relative to one another in a transverse direction. The band holder drive assembly 330 is similar to the gripper drive assembly. A pair of spaced-apart belt pulleys 336 are rotatably mounted to a frame member 334. A drive belt 338 is entrained around the belt pulleys 336. One of the belt pulleys is driven by a belt motor 340. Belt motor 340 is preferably a servo-motor under the control of a programmable controller.

Each of the band holders 302 are clamped to the drive belt 338. The clamping block 306 of the band holder includes a clamping member 310 which compresses the drive belt 338 between the clamping member 310 and clamping block 306. Each of the band holders 302 is clamped to a respective run of the drive belt 338. One of the hand holders 302 is clamped to a lower run of the drive belt 338, while the opposite hand holder 302 is clamped to the upper run of the drive belt 338. Thus, the hand holders 302 move in opposite directions relative to one another. The clamping block 306 includes a guide channel 308 which engages with a track 332 on the frame member 334 to guide the movement of the hand holder 302.

The holding fixture 300 is mounted on a positioner 350 which moves the holding fixture 300 in two directions and rotates the holding fixture 300. The positioner 350 includes a turntable 352 which is connected to a rotary actuator 354. The turntable 352 and rotary actuator 354 allow the holding fixture 300 to he rotated.

The turntable 352 and rotary actuator 354 are mounted to a linear slide 356. Linear slide 356 moves the holding fixture 300 in the "y" direction (i.e., perpendicular to the direction of feed of the cuff material). Linear slide 356 includes a track 358 and a slide member 360. The rotary actuator 354 is mounted on the slide member 360.

Linear slide 356 is mounted on a second linear slide 362. Linear slide 362 allows the holding fixture 300 to he moved in the "x" direction (forwardly and backwardly along the direction of feed of the cuff material). Linear slide 362 includes a track 364 and a slide member 366. Slide member 366 supports the track 358 for the first linear slide 356.

The holding fixture 300 cooperates with the cuff puller assembly 160 to pull the cuff material forwardly so that it can he severed by the cutter assembly 200. When the tubular cuff material is pulled forwardly, it will he slightly stretched. While the cuff material is being pulled, the finger sleeve 320 is normally in an open position so that the cuff material forms a cup in the space between the end of the finger sleeve 320 and the shoulder 318. After the cuff material is pulled out, the finger sleeve 320 is moved to a closed position. When the finger sleeve 320 is moved to the closed position, a portion of the cuff material is pinched between the finger sleeve 320 and the shoulder 318. The cutter assembly 320 then severs the cuff material to form a circular band. The finger sleeve 320 remains in a closed position while the holding fixture 300 is moved to the cuff folder assembly 400. The circular band is pinched approximately mid-way between the ends of the band.

Cuff Folder Assembly

Figure 10:
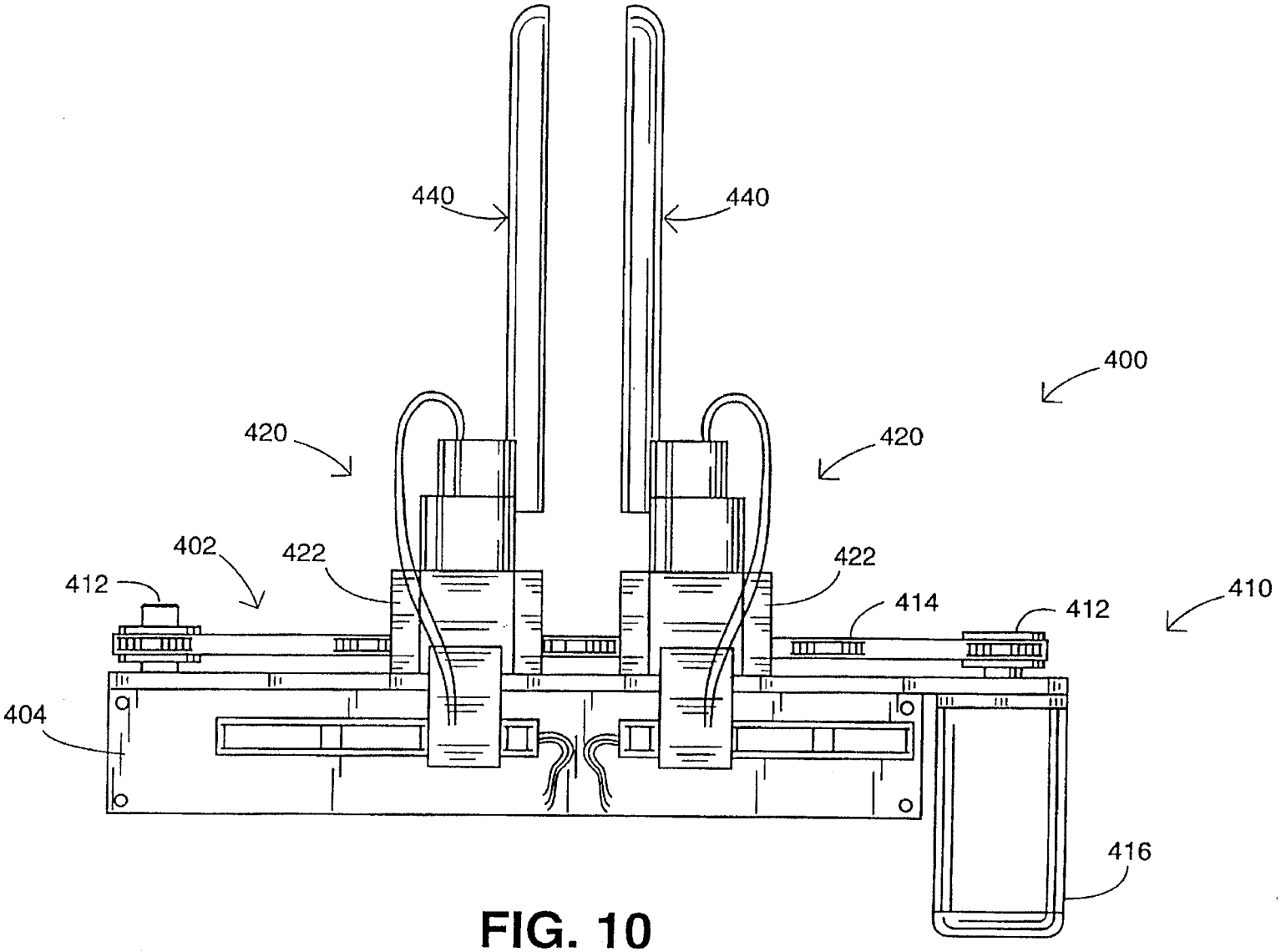
FIG. 10 is a top plan view of the cuff folder assembly.
Figure 11:
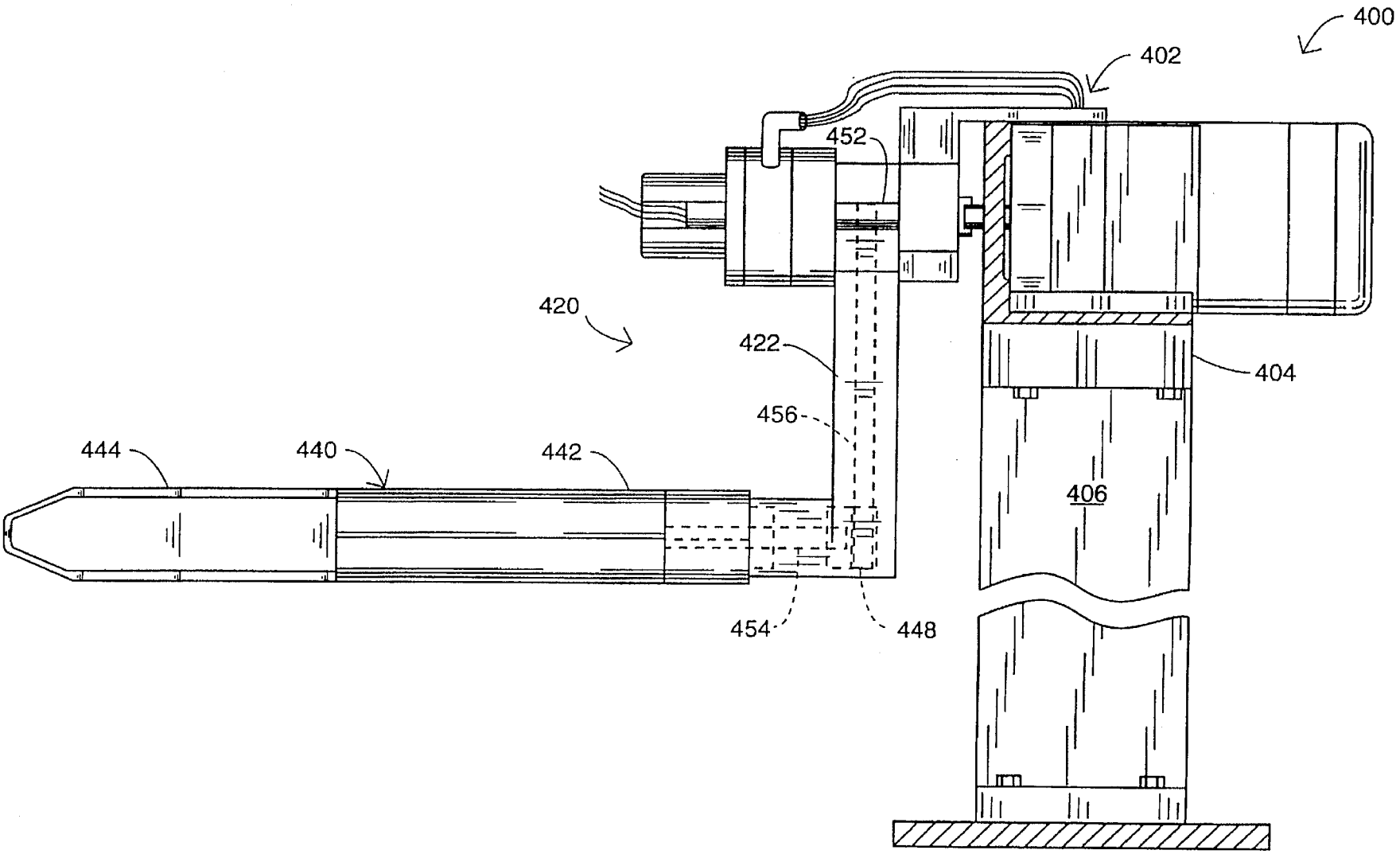
FIG. 11 is a side elevation view of the cuff folder assembly.

The cuff folder assembly 400, shown in FIGS. 10 and 11, includes a pair of cuff folders 420 and a cuff folder drive assembly 402 for adjusting the distance between the cuff folders 420 depending upon the size of the cuff being made.

The cuff folder drive assembly 402 includes a frame member 404 which is supported on support posts 406. A pair of belt pulleys 412 are rotatably mounted on opposite ends of the frame 404. A drive belt 414 is entrained around the belt pulleys 412. One of the belt pulleys 412 is driven by a belt motor 416. Belt motor 416 is preferably a stepper motor under the control of a programmable controller.

The cuff folders 420 are secured to respective runs of the drive belt 414. One of the cuff folders 420 is mounted to an upper run of the drive belt 414, while the other cuff folder 420 is secured to the lower run of the drive belt 414. Thus, the cuff folders 420 will move in opposite directions relative to one another.

Each of the cuff folders 420 includes a support arm 422. A clamping block 424 is secured to each support arm 422. Each clamping block 424 includes a clamping member 426 which compresses the drive belt 414 between the clamping block 424 and clamping member 426.

A guide block is secured to each clamping block 422. The guide block includes a channel which engages with a track on the frame member 404. The guide block and track prevent the support arm 422 from twisting.

The support arm 422 supports a rotating finger 440. The rotating finger 440 includes a tubular rear section 442 and a forward section 444. The forward section 444 is formed by removing half of the tube. A pair of diametrically opposed slots are formed in the rear section 442 so that the rear section 442 functions like a clamp. Screws are tightened to clamp the tubular rear section 442 onto a drive shaft 454. The drive shaft 454 is connected by a belt 456 to a rotary actuator 452. The motor 452 is preferably an air motor. When the motor 452 is actuated, the fingers 440 are rotated 180°. In use, the folder assembly 400 folds the circular band held by the holding fixture 300 to form a double layer cuff. To fold the circular band, the holding fixture 300 moves along track 358 until it is aligned with the cuff folder assembly 400. The spacing between the rotating fingers 440 is adjusted to be equal to the spacing between the support fingers 312. The rotating fingers 440 of the cuff folder assembly 400 are inserted into the cuff by moving the holding fixture 300 forwardly. The forward section 444 of the rotating fingers 440 extends approximately half the distance into the circular bands and encircles the inner side of the support fingers 312. After the rotating fingers 440 are inserted, the rotary actuator 452 is actuated to rotate the fingers 440 to the outside of the support fingers 312. In this position, the forward section 444 of the rotating fingers 440 is interposed between the circular band and the support fingers 312. The holding fixture 300 is then moved forwardly. As the holding fixture 300 moves forwardly, the forward section 444 of the rotating fingers 440 folds one end of the circular band back to double the circular band onto itself. After the circular band is folded upon itself, the holding fixture 300 moves back away from the cuff folder assembly 400.

Operation

Figure 12A:
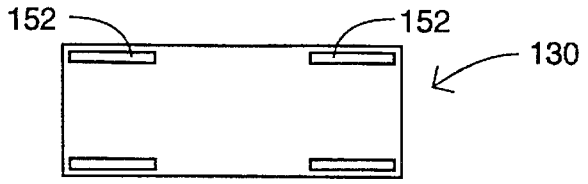
FIGS. 12A–12E are schematic diagrams showing the sequence of operations of the holding fixture and cuff puller assembly during the material feed.
Figure 12B:
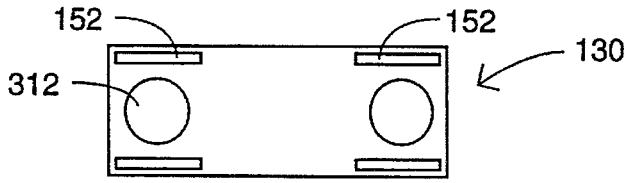
Figure 12C:
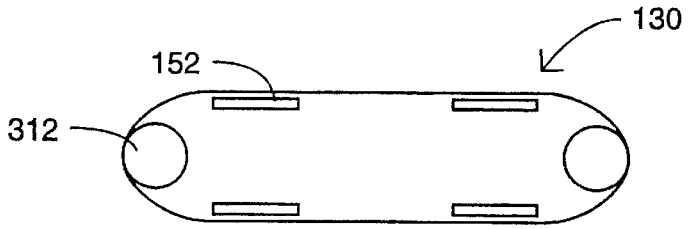
Figure 12D:
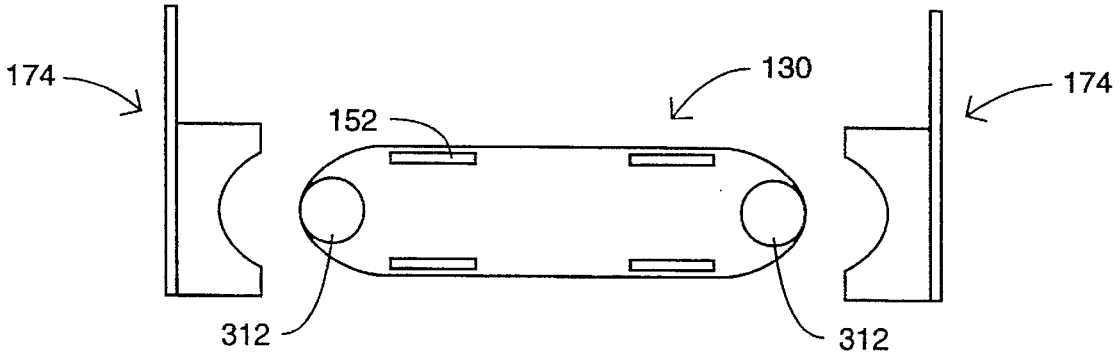
Figure 12E:
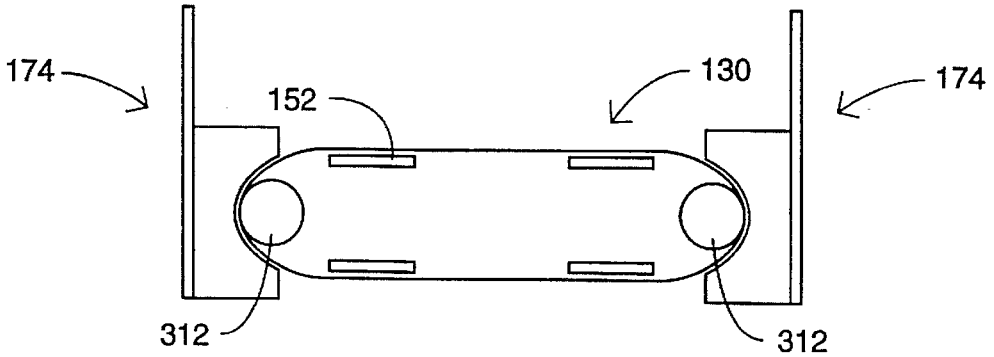

At the beginning of a cycle, the cuff material is disposed around the tube opener assembly 130 as shown in FIG. 12A. The holding fixture 300 is positioned in line with the cuff material feed with the support fingers 312 pointed toward the cuff material feed. The holding fixture 300 moves forwardly to insert the support fingers 312 into the tube opener assembly 130 as shown in FIG. 12B. The support fingers 312 are then spread apart as shown in FIG. 12C to stretch the cuff material laterally. The puller assembly moves forwardly to position the grippers 174 adjacent to the support fingers 312 as shown in FIG. 12D. The grippers 174 are closed to clamp the cuff material against the support fingers 312 as shown in FIG. 12E. The cuff puller assembly 160 and holding fixture 300 then move rearwardly along the direction of the feed to pull the tubular cuff material off the tube opener assembly 130.

Figure 13A:
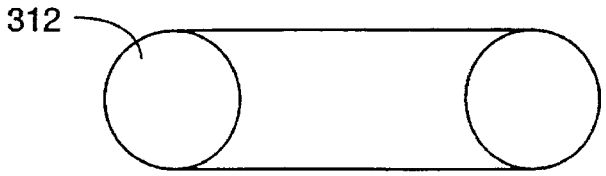
FIGS. 13A–13D are schematic diagrams showing the sequence of operations of the holding fixture and cuff folder assembly during the cuff folding operation.
Figure 13B:
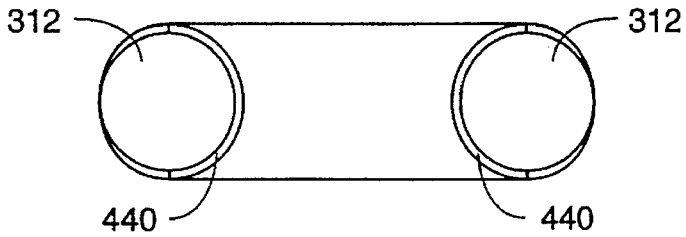
Figure 13C:
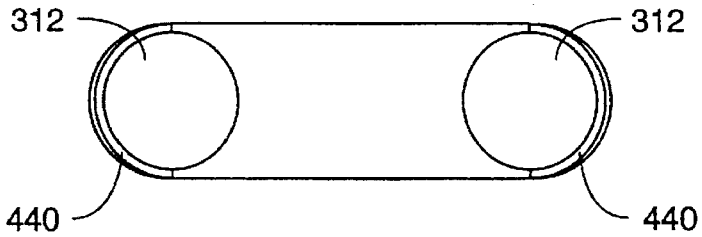
Figure 13D:
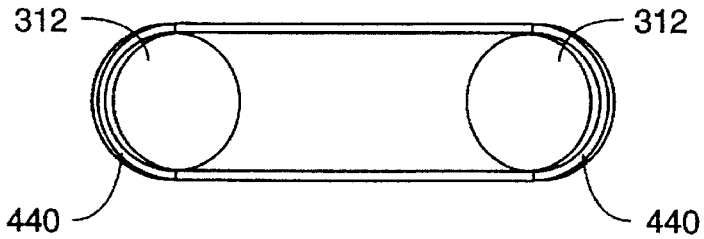

When the cuff material is pulled by the cuff puller assembly 160, a slight tension is placed on the cuff material. The tension on the cuff material causes the cuff material to form a cup and a space between the end of the finger sleeve 320 and the shoulder 318 of the support fingers 312. The finger sleeve 320 is moved to a closed position to pinch the cuff material. The cutter assembly 200 then is extended and the cutter cylinder is actuated to sever the cuff material to form a circular band. The circular band is held by the holding fixture which then moves to a position in line with the cuff folder assembly 400. The cuff material is supported by the support fingers 312 as shown in FIG. 13A. The holding fixture 300 is then moved forwardly by actuating linear slide 356. As the holding fixture 300 moves forwardly, the rotating fingers 440 are inserted into the cuff. The holding fixture 300 continues to be moved forwardly until the rotating fingers extend approximately half the distance into the circular band. The rotating fingers 440 are positioned so that the forward section 444 encircles the inner half of the support fingers 312 (see FIG. 13B). The rotating fingers 440 are then rotated 180° to the outside of the support fingers, as shown in FIG. 13C, to lift the front end of the cuff material off the support fingers 312. The holding fixture 300 is then again actuated to move forwardly towards the cuff folder assembly 400. As the holding fixture moves forwardly, the rotating fingers 440 fold the front end of the cuff material back over the back end of the cuff material to double the circular band onto itself. After the circular band is folded upon itself, the holding fixture 300 moves back away from the cuff folder assembly. Once the cuff has been made, it can be inserted and sewn into the sleeve of the garment either manually or as part of an automatic system.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. An apparatus for making a cuff from a continuous supply of tubular material, said apparatus comprising:

(a) a material feed for advancing the tubular material;

(b) a cutter disposed adjacent the material feed for severing the tubular material to form a circular band;

(c) a holding fixture for holding the circular band severed from the tubular cuff material; and (d) a folding mechanism for folding the circular band on said holding fixture upon itself to form a double-layer cuff.

2. The apparatus according to claim 1, wherein the material feed comprises a set of feed rollers for advancing the tubular material and a tube opener assembly for opening the tube as it is advanced.

3. The apparatus according to claim 1, wherein the cutter comprises a vertically movable blade and a stationary blade for shearing the cuff material.

4. The apparatus according to claim 3, wherein the cutter is movably mounted for movement in a direction perpendicular to the direction of feed of the tubular material between a retracted position and a cutting position.

5. The apparatus according to claim 1, wherein the folding mechanism comprises a pair of fingers for engaging one end of said circular band while said circular band is supported on said holding fixture moving towards the opposing end to fold the band while it is held by said holding fixture.

6. An apparatus for making a cuff from a continuous supply of tubular material, said apparatus comprising:

(a) a material feed for advancing the tubular material;

(b) a cutter disposed adjacent the material feed for severing the tubular material to form a circular band;

(c) a holding fixture for receiving and holding the circular band severed from the tubular cuff material in an open position, said holding fixture including gripping means formed in said holding fixture for gripping the circular band between the ends thereof; and (d) a folding mechanism for folding the circular band on said holding fixture upon itself to form a double-layer cuff.

7. The apparatus according to claim 6, wherein the material feed comprises a set of feed rollers for advancing the tubular material and a tube opener assembly for opening the tube as it is advanced.

8. The apparatus according to claim 6, wherein the cutter comprises a vertically movable blade and a stationary blade for shearing the cuff material.

9. The apparatus according to claim 8, wherein the cutter is movably mounted for movement in a direction perpendicular to the direction of feed of the tubular material between a retracted position and a cutting position.

10. The apparatus according to claim 6, wherein the folding mechanism comprises a pair of fingers for engaging one end of said circular band while said circular band is supported on said holding fixture moving towards the opposing end to fold the band while it is held by said holding fixture.

11. The apparatus according to claim 6, wherein the holding fixture includes a pair of generally cylindrical fingers insertable in the circular band, said fingers being movable between a closed position to facilitate insertion of the fingers into said circular band and an expanded position in which the fingers are spread apart from one another to stretch the circular band.

12. The apparatus according to claim 11, wherein said gripping means is formed on said pair of fingers for gripping the circular band between the ends thereof.

13. The apparatus according to claim 12, wherein said gripping means includes first and second cylindrical portions which are movable relative to one another between a clamping position and a release position, and wherein the circular band is gripped between the first and second cylindrical portions when the cylindrical portions are in the clamping position.

14. The apparatus according to claim 13, wherein the first and second cylindrical portions are movable in an axial direction relative to one another.

15. A method for making a cuff from a continuous supply of tubular material, said method comprising the steps of:

(a) advancing the tubular material by a material feed;

(b) severing the tubular material to form a circular band by a cutter disposed adjacent the material feed;

(c) receiving and holding the circular band severed from the tubular cuff material in an open position in a holding fixture, said holding fixture including gripping means formed in said holding fixture for gripping the circular band between the ends thereof; and (d) folding the circular band on said holding fixture upon itself to form a double-layer cuff by a folding mechanism.

* * * * *